US005213294A

United States Patent [19]

DeBord

[11] Patent Number: 5,213,294

[45] Date of Patent: May 25, 1993

[54] LOCKING SUPPORT FOR REFUSE CAN

[76] Inventor: Walter J. DeBord, 12212 Pueblo Rd., Gaithersburg, Md. 20878

[21] Appl. No.: 853,208

[22] Filed: Mar. 18, 1992

[51] Int. Cl.[5] ..... A47G 23/02

[52] U.S. Cl. ..... 248/147; 16/374; 220/335; 220/480; 220/481; 220/482; 248/552; 248/907

[58] Field of Search ..... 248/907, 309.1, 147, 248/152; 220/480, 481, 482, 335; 211/71; 16/389, 374

[56] References Cited

U.S. PATENT DOCUMENTS

| | | | |
|---|---|---|---|
| 2,448,456 | 8/1948 | Niskanen et al. . | |
| 2,471,257 | 5/1949 | Blank . | |
| 3,128,981 | 4/1964 | Puetsch et al. . | |
| 3,255,986 | 6/1966 | Eadie . | |
| 3,268,086 | 8/1966 | Hendrickson | 211/71 |
| 3,279,619 | 10/1966 | Alissandratos . | |
| 3,450,297 | 6/1969 | Clerk | 248/147 X |
| 3,561,710 | 2/1971 | Cummings | 248/147 |
| 3,625,370 | 12/1971 | Mintz | 211/71 |
| 3,666,223 | 5/1972 | Moore | 211/71 X |
| 3,831,838 | 8/1974 | Kline et al. | 248/907 X |
| 4,184,659 | 1/1980 | Abrahamson | 211/71 X |
| 4,191,297 | 3/1980 | Hardman | 248/907 X |
| 4,517,775 | 5/1985 | Engel | 248/907 X |
| 4,527,695 | 7/1985 | Arms | 211/71 |
| 4,860,909 | 8/1989 | Leumi | 248/907 X |

*Primary Examiner*—Ramon O. Ramirez
*Attorney, Agent, or Firm*—Michael de Angeli

[57] ABSTRACT

Support structure for a refuse can comprises a base support adapted to receive the flange of a conventional refuse can. A locking bracket comprises a male member fixed to the can and fitting within an aperture in a female member mounted on a support structure and lockable therein, to prevent the refuse can from being removed from the base support. The lid of the can may be hinged to the support structure or to the can, to encourage users to replace the lid over the open end of the can.

20 Claims, 2 Drawing Sheets

LOCKING SUPPORT FOR REFUSE CAN

BACKGROUND OF THE INVENTION

1. Field of the Invention

This invention relates to a support for a refuse can. More particularly, this invention relates to a locking support for a refuse can particularly intended for use in public areas such as parks, that is inexpensive to manufacture, that does not inconvenience cleaners or maintenance personnel, and that is resistant to vandalism, weather, animals, insects and the like.

2. Description of the Prior Art

The prior art shows many attempts to provide a suitable stand for supporting a refuse can or similar receptacle for trash above the ground. U.S. Pat. No. 2,448,456 to Niskanen et al shows a support for a refuse can including an arcuate base support engaging the flange by which the side wall of a conventional cylindrical refuse can is joined to its base. The Niskanen base support also includes a guide assisting one lowering the can onto the base support to place the flange properly against the arcuate support. Niskanen shows a hook receiving one of the two opposed handles conventionally provided on a refuse can for retaining the can in its upright position on the base support. Employment of the gripping handle to support the can upright on the base support would interfere with a cleaner's use of the handles to lift the can, e.g., for emptying and cleaning. Further, this structure is not resistant to vandals, as no means is provided to retain the handle on the hook. Niskanen also shows a chain for securing the lid to the trash can. While this may prevent wind or vandals from removing the lid, the tendency will be for users to simply let the lid dangle by the can.

U.S. Pat. No. 3,255,986 to Eadie shows another support for a refuse can including a base support mounted on a post for retaining the can by the flange at which the base meets the side wall. Eadie additionally shows a male member mounted to the side wall of the can and extending downwardly for being received in a female member mounted on the post for retaining the can upright on the base support. The structure shown by Eadie is not amenable to lockably retaining the can on the post, to secure the can against vandalism or the like. While Eadie shows a lock at the top of the post, apparently provided to retain a lid support structure on the post, the Eadie structure could not readily be modified to lockably secure the can in its upright position on the base support.

Other patents showing support structures for refuse cans of various types include Engel U.S. Pat. No. 4,517,775, Arms U.S. Pat. No. 4,527,695, Puetsch et al U.S. Pat. No. 3,128,981, Allissandratos U.S. Pat. No. 3,279,619 and Blank U.S. Pat. No. 2,471,257. Of the latter, Puetsch et al and Blank show devices engaging the handle provided at the center of a conventional flat refuse can cover for selectively retaining the cover of the can in an open position. These devices are evidently designed to encourage users to replace the lid on the can rather than discard the lid or allow it to dangle by a chain as shown by Niskanen. However, none of the structures in these references are suitable for refuse cans to be used in public spaces, particularly in parks.

More specifically, a refuse can support for use in a public park must have several distinct attributes. Obviously, the can support must be durable, inexpensive, and simple to install. It must be simple to use, as otherwise cleaners will not properly attend to cleaning and emptying of the cans. A suitable can support must resist theft of either the can or the lid, and resist vandalism directed to either. Users should be encouraged to close the lid of the can to prevent access of animals and insects to the interior of the can. Finally, a support for a refuse can must be useful with standard metal refuse cans. That is, a support structure for a refuse can useful only in conjunction with a particular or specially manufactured refuse can would not be satisfactory; such a support must be useful with a variety of commercially available, low cost refuse cans. In particular, any lid retaining structure must function with can lids having domed centers and spring-loaded doors, as preferably provided in public areas.

In addition to the patent references discussed above, the applicant is also aware of various equipment marketed for use in public parks for supporting refuse cans off the ground. However, the inventor is aware of no product adequately satisfying the deficiencies of the prior art and addressing the needs of the invention identified above.

OBJECTS AND SUMMARY OF THE INVENTION

It is therefore an object of the invention to overcome the deficiencies of the prior art noted above, and specifically to provide an inexpensive and convenient locking support assembly for lockably supporting a standard refuse can such that the can cannot be dislodged from its support by vandals, weather, or animals, but may readily be removed for emptying, cleaning and the like.

It is a further object of the invention to provide a support assembly for a refuse can as above, and additionally comprising a support for a domed lid arranged such that users are encouraged to replace the lid in its closed position on top of the can.

These and other objects of the invention which will be apparent as the discussion below proceeds are met by the present invention of a locking support assembly for a standard refuse can. The support assembly comprises a base support for supporting the weight of the can and a locking bracket for retaining the can on the base support. Both the base support and one member of the locking bracket are typically mounted on a vertical structure, such as a vertical post or a wall. The base support grips the flange of the can. The locking bracket retains the can in its proper position on the base support member. In the preferred embodiment, the locking bracket comprises a male member on the can which extends vertically downwardly into an aperture of a female member fixed with respect to the vertical structure. The male member is drilled through at its tip to receive the hasp of a padlock or the like, preventing removal of the male member from the female member, and precluding removal of the refuse can from the base support. The lid of the can may be supported by a hinge mounted either on the vertical structure or on the can, so that the user is not tempted to simply discard the lid. The base support may comprise a pair of arcuate bands defining a recess therebetween for receiving the generally arcuate flange formed at the base of a conventional cylindrical refuse can.

BRIEF DESCRIPTION OF THE DRAWINGS

The invention will be better understood if reference is made to the accompanying drawings, in which:

FIG. 3 is a detail of an alternative embodiment of the locking bracket of the refuse can support assembly of the invention; and FIG. 4 is a view comparable to FIG. 3 showing a further embodiment of the locking bracket.

DESCRIPTION OF THE PREFERRED EMBODIMENTS

Figure 1:
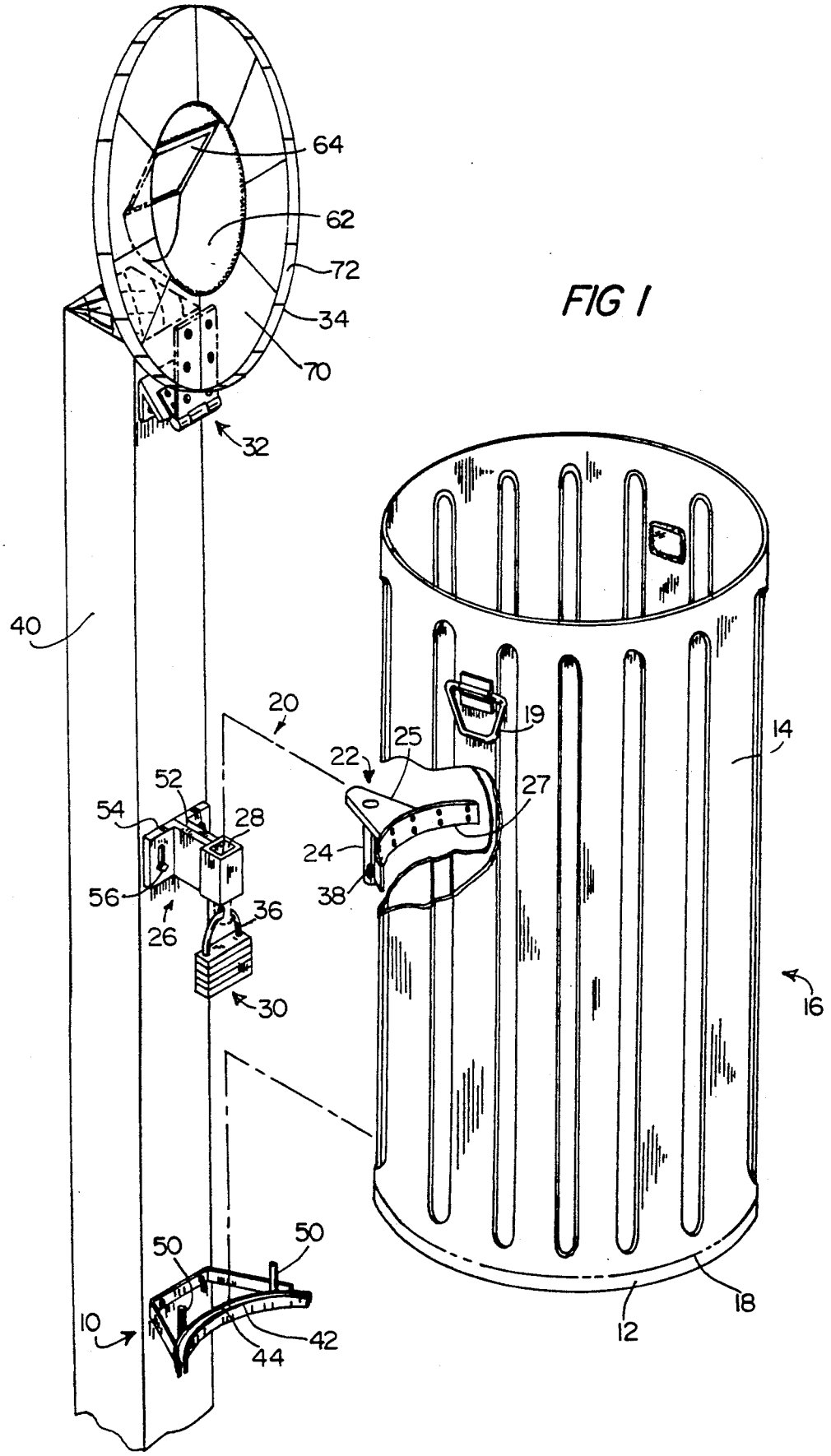
FIG. 1 is an exploded perspective view of the lockable refuse can support assembly of the invention, showing a typical refuse can in phantom.

The refuse can support assembly of the invention is intended principally for use with conventional refuse cans made of galvanized steel, specifically for use with cans comprising a generally cylindrical side wall section having two handles on opposite sides thereof, and a base joined to the side wall at a depending cylindrical flange. Thus, as shown in FIG. 1, a refuse can support assembly according to the invention comprises a base support 10, adapted to receive a flange 12 typically formed where the side wall 14 of the typical refuse can 16 meets its bottom surface, indicated generally by 18, and a locking bracket indicated generally at 20. Locking bracket 20 comprises a male member 22 including a pin 24, a female member 26 including an aperture 28 for receiving pin 24, and a conventional padlock 30 having a hasp 36 for being received in a bore 38 through pin 24, and thus securing the male member 22 with respect to the female member 26. The refuse can support assembly may be provided together with a hinged lid support 32 for supporting the lid 34 of the conventional refuse can 16. The refuse can support assembly of the invention, comprising the base support 10 and one of the mating components of the locking bracket 20, may both be mounted on a vertical surface of a vertical structure 40, such as a post as shown, or a wall of a building or the like.

Figure 2:
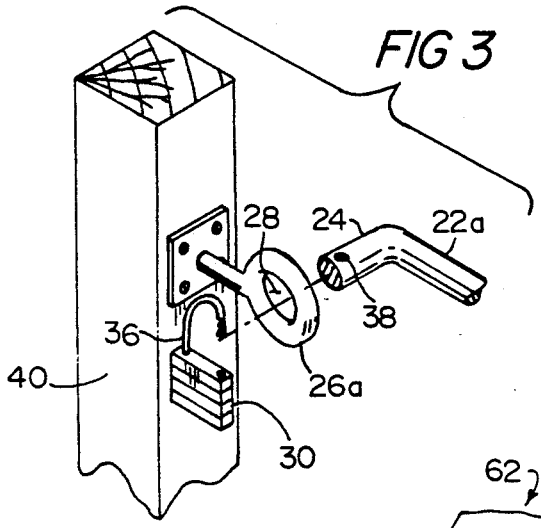
FIG. 2 is a second perspective view of the refuse can support assembly in a somewhat different embodiment than that of FIG. 1, and taken from a different view in order to show further details.
Figure 2:
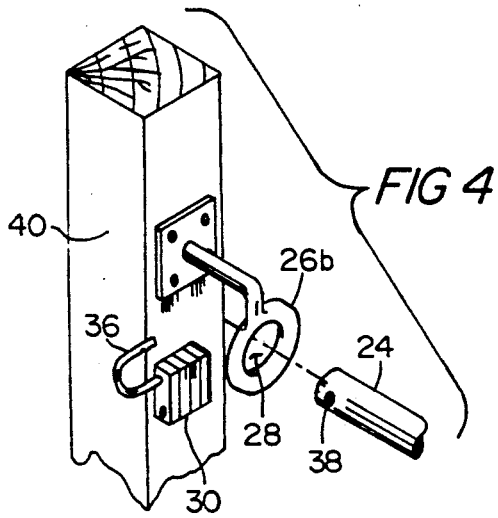
Figure 2:
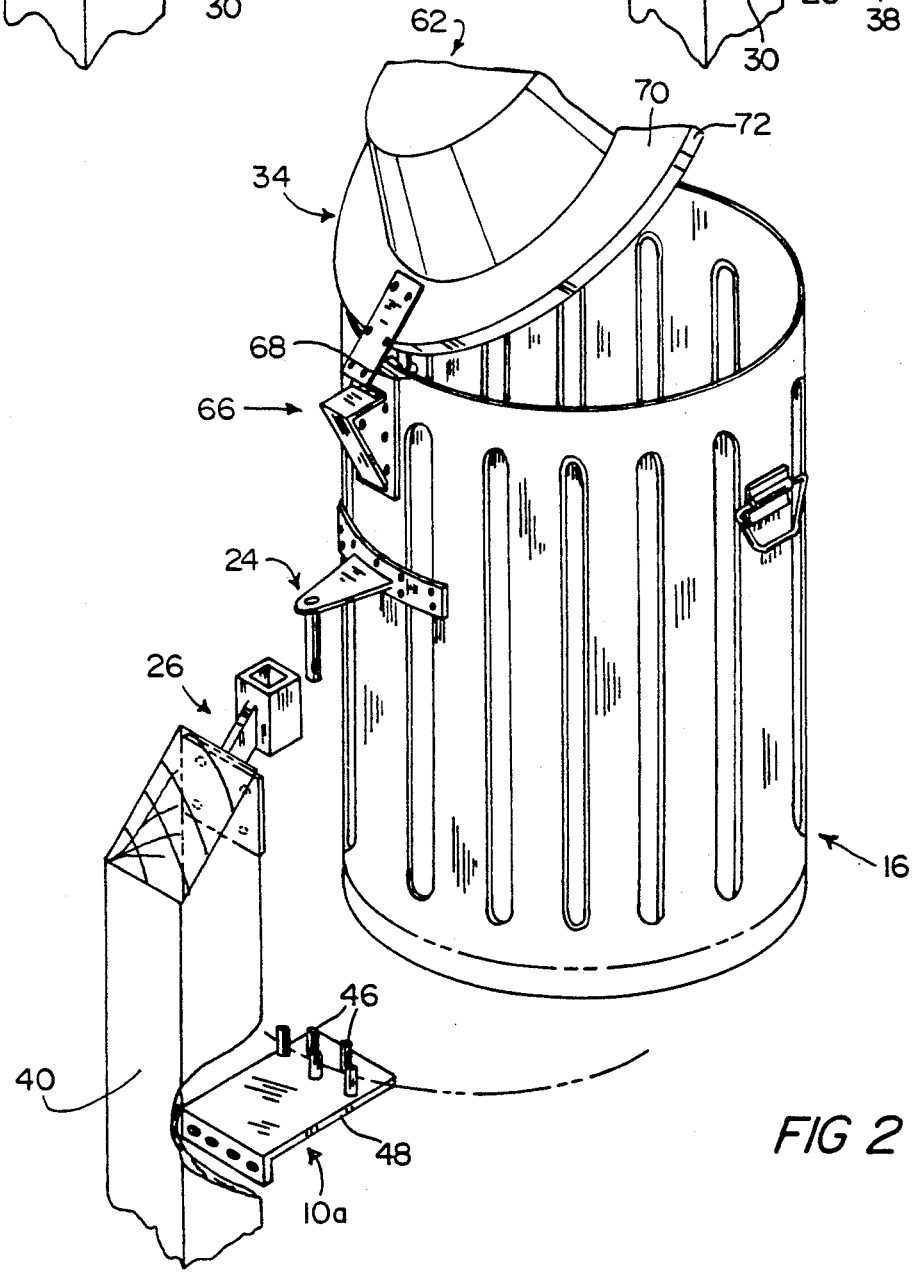

Referring now in more detail to the structure of the components of the refuse can support assembly of the invention, the base support 10 grips and supports the refuse can. As indicated above, it is an object of the invention to enable the locking support assembly of the invention to be used with conventional cylindrical refuse cans fabricated of galvanized steel. Such a refuse can typically comprises a generally cylindrical (or slightly conical) side wall 14 joined to a base 18 by a generally cylindrical depending flange 12. Accordingly, the flange 12 may be received in an arcuate recess opening upwardly. The recess may be defined by a pair of spaced metallic bands 42 and 44, as indicated in FIG. 1, or may comprise several pegs 46 mounted on a generally planar member 48 as indicated in FIG. 2. The base support 10 shown in FIG. 1 desirably comprises guide members 50 to assist a cleaner in disposing the flange 12 within the recess defined between the bands 42 and 44. As shown, guides 50 may comprise simple rod-like members extending upwardly from the rear band 44. Similar guides may be provided as part of the base support 10*a* in the embodiment of FIG. 2. The base support 10 may simply be bolted to the vertical structure 40.

As indicated the refuse can 16 is supported by the base support 10. The can 16 is maintained in its proper upright position on the base support 10 by a lockable securing bracket 20. Lockable bracket 20 comprises a male member indicated generally at 22 comprising a pin 24 adapted to be received within an aperture 28 defined by a female member 26 mounted on the vertical structure 40, and locked therein by a lock 30. More specifically, the male member 22 comprises a pin 24, a spacer member 25 spacing the pin 24 some distance from the side wall 14 of the refuse can 16, and a flange 27 by which the spacer 26 may be readily bolted to the refuse can 16. The aperture 28 of the female member 26 may be defined by a short section of square-section tubing as shown in FIG. 1, or by a short section of circular-section pipe, a hole in a metallic member, such as a section of steel "angle iron", an eyebolt, a U-bolt, or the like. The aperture 28 defined by the female member 26 is spaced away from the vertical structure 40 by a second spacer member 52 in turn fixed to a flange 54. Preferably, as shown, slotted holes are formed in flange 54 for receiving bolts 56 for securing the female member 26 with respect to the vertical structure 40, while providing convenient vertical adjustment of its respective position. The base support 10 and the male member 22 may likewise be mounted to the vertical structure 40 or the can 16 respectively by bolts extending through slotted holes. Where the vertical structure 40 is a pipe, U-bolts extending around the pipe may conveniently be employed to secure the base support 10 and the female member 26 thereto. Other mounting arrangements are within the skill of the art.

The hasp 36 of lock 30 is locked in a bore 38 extending transversely through pin 24 to secure the pin 24 within the aperture 28. The pin 24 fits relatively snugly within the aperture 28 so that without removing the lock 30 there is no possibility of removing the flange 12 of can 16 from the recess formed by the base member 10. In this way, while the lock 30 is in position, the can is securely fixed to the vertical structure 40; however, the can may be readily removed therefrom for emptying and cleaning by simply removing the lock 30 and lifting the can vertically, simultaneously removing the pin 24 from the aperture 28 and the flange 12 from the recess formed between bands 42 and 44.

It will be appreciated by those of skill in the art that numerous prior art refuse can support structures rely on hooks or the like engaging the can handles 19. Such arrangements could not readily be made lockable so as to prevent removal of the flange 12 from the base support 10, and would also interfere with use of the handles 19 by cleaners. According to the invention the handles 19 are left free for use by cleaners. Moreover, the relatively snug fit between the pin 24 and the aperture 28 precludes removal of the flange 12 of the can 16 from base support 10, that is, from the recess formed between the bands 42 and 44.

Spacer members 25 and 52 ensure adequate room for a cleaner to reach between the can 16 and support structure 40 in order to remove and attach the lock 30 as needed to remove the can for emptying and cleaning.

It is often desired in public areas such as parks to provide refuse can 16 with lids 34, optionally having dome sections 62 (e.g., as shown in FIG. 2) and spring-loaded doors 64. Such lids 34 prevent the entry of animals and substantial quantities of insects into the can 16. However, commonly such lids 34 are not properly attached to the can and may be discarded or lost by careless users, wind or vandals; alternatively, if the lid is chained to the support structure as suggested in the Niskanen et al patent discussed above, the user will not be encouraged to put the lid properly back on the can. According to the present invention, a pivoted hinge structure indicated generally at 32 (FIG. 1) is provided, whereby the lid may be pivotably mounted to the support structure 40; alternatively, as shown in FIG. 2, a pivoted hinge structure 66 may be provided whereby the lid 34 is pivotably mounted to the can 16. In either event the user needs simply to flip the lip 34 down to cover the can. This simple action is sufficiently readily performed to encourage most users to do so.

In order to limit the excursion of the lid 34 provided by the pivoted hinge structures 32 (FIG. 1) or 66 (FIG. 2) a strap may be provided. In the embodiment of FIG. 2, strap 68 extends between the can 16 and the lid 34. In the embodiment of FIG. 1, such a strap (not shown) may be secured between the support structure 40 and the lid 34.

As noted above, prior art structures for retaining refuse can lids have typically been secured to the handle affixed to the center of a flat circular lid having a flange for fitting over the wall of the can. The present invention is intended to be useful in connection with domed refuse can lids not including such handles. Accordingly, in both embodiments shown of the pivoted hinge structure of the invention, one of the pivoted members of the hinge is secured to a flat peripheral portion 70 of the lid surrounding the dome 62, or to the flange 72, while the other member of the hinge may be secured to the vertical structure (FIG. 1) or to the can (FIG. 2).

In the preferred embodiment, as shown in FIGS. 1 and 2, the axis of aperture 28 is vertical, so that the pin 24 moves downwardly to enter the aperture 28 as the flange 12 enters the recess defined by base support 10, which opens upwardly. The bore 38 in pin 24 for receiving hasp 36 is accordingly substantially horizontal, arranged at an angle of at least about 45° and preferably generally perpendicular to the plane including spacers 25 and 52; in this way one attempting to insert the hasp 36 in the bore 38 can see the bore.

However, other cooperative arrangements of the aperture and pin are within the skill of the art and the scope of the invention. FIG. 3 shows an example in which female member 26*a* is configured as an eye-bolt and the axis of the aperture 28 is horizontal, opening laterally to either side of a plane including spacers 25 and 52, that is, a plane extending between the can 16 and the vertical structure 40. The pin 24 of the male member 22*a* accordingly enters the aperture 28 along a horizontal axis, that is, effectively by rotating the can 16. In this embodiment the bore 38 in the tip of the male member 22*a* is essentially vertical to enable ready insertion of the hasp 36 of the lock 30.

In the embodiment of FIG. 4, the axis of the aperture 28 in the female member 26*b* is again horizontal but extends outwardly towards the can. In this case the distal tip of pin 24 of the male member enters the aperture 28 along a generally horizontal axis toward the support structure 40. Thus one would insert the pin 24 in the aperture 28 by resting the can on the base support 10 and tipping the can toward an upright position. The bore 38 is preferably horizontal.

It will be appreciated from consideration of the several embodiments of the locking bracket 20 that in each case the axis of the aperture 28 and the axis of the distal tip portion 24 of the male member 22 are generally aligned, and that the bore 38 in the tip of the male member is orthogonal thereto. As noted, the bore 38 in the pin 24 of the male member 22 is preferably visible to a cleaner or the like to assist in placing the hasp 36 of the lock 30 therethrough. For example, in the embodiment of FIG. 1, the axis of bore 38 should be at least 45° and is preferably essentially perpendicular to the plane including the direction of elongation of the spacers 25 and 52, so that the bore 38 will be visible to a cleaner attempting to insert the hasp 36 of the lock 30 from one side. In each embodiment the base support 10 and locking bracket 20 may be constructed so that the can tends to lean toward vertical structure 40 when placed on the base support 20, simplifying the insertion of the hasp 36 of lock 30 into bore 38.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A locking bracket for securing a refuse can to a substantially vertical structure, said refuse can comprising a base and a side wall, said side wall being fixed at one end to said base and open at its other end, said vertical structure having mounted to it a base support for receiving the base of the refuse can and supporting the weight of the refuse can, said locking bracket comprising:

a female member comprising means defining an aperture for receiving a male member and means for fixing said means for defining an aperture to one of the side wall of the refuse can and the vertical structure, said means for fixing comprising a first spacer for spacing said means defining an aperture from said one of the side wall of the refuse can and the vertical structure;

a male member comprising an elongated pin, said pin including a proximal end portion and a distal end portion, and means for fixing said proximal end portion of said pin to a second spacer for spacing said pin from the other of said side wall of said refuse can and said vertical structure; and said distal end portion of said pin being sized to fit snugly within and extend through said aperture defined by said female member, a bore extending transversely through said distal end portion of said pin for receiving the hasp of a lock, whereby said pin may be prevented from being withdrawn from said aperture defined by said female member by locking said hasp in said bore.

2. The locking bracket of claim 1, wherein said first and second spacers whereby said pin and said means defining an aperture are fixed to respective ones of said wall of said refuse can and said vertical structure lie generally in a vertical plane extending outwardly from a surface of the vertical structure.

3. The locking bracket of claim 2, wherein the axis of said bore in said distal end portion of said male member is substantially horizontal and forms an angle of at least about 45° to said plane.

4. The locking bracket of claim 1, wherein said female member and said male member are cooperatively mounted such that as the refuse can is lowered onto the base support member, the male member moves with respect to the female member so as to enter the female member in a generally vertical direction.

5. The locking bracket of claim 4, wherein the axis of said bore in said male member extends substantially horizontally.

6. The locking bracket of claim 4, wherein said female member is mounted to said vertical structure and said male member is mounted to said refuse can, whereby said distal end of said male member extends generally downwardly from said proximal end thereof.

7. The locking bracket of claim 1, wherein said female member is mounted such that the axis of the aperture defined thereby is substantially horizontal, said distal end portion of said pin extending generally horizontally, and said bore in said distal end portion lying in a substantially vertical plane.

8. The locking bracket of claim 7, wherein the axis of the aperture in said female member extends substantially outwardly between said vertical structure and said refuse can.

9. In combination, the locking bracket of claim 1 and a base support for receiving the base of a refuse can and supporting the refuse can.

10. The combination of claim 9, wherein said base support comprises means opening generally vertically for receiving a segment of a flange whereby a side wall of a refuse can is joined to a base thereof.

11. The combination of claim 10, wherein said base support further comprises guide means for abutting an edge of the flange of a refuse can and guiding the flange into said arcuate recess.

12. The combination of claim 10, wherein said means opening generally vertically comprises means for defining an arcuate recess for receiving a generally cylindrical segment of the flange of a standard refuse can.

13. The combination of claim 12, wherein said arcuate recess is defined between two arcuate band members spaced from one another.

14. The combination of claim 9, in further combination with a lid fitting over an upper open end of said refuse can and a hinge pivotally securing said lid to one of the side wall of the refuse can and the vertical structure.

15. The combination of claim 14, further comprising a strap limiting pivotal motion of said lid with respect to said one of the side wall of the refuse can and the vertical structure.

16. A support assembly for supporting a refuse can on a vertical structure, comprising:

a base support for receiving the base of the refuse can and supporting the refuse can;

a locking bracket, said locking bracket comprising:

a female member comprising an aperture, said female member being mounted to one of said can and said vertical structure by means spacing said aperture therefrom;

a male member having a proximal end portion mounted to the other of said can and said vertical mounting structure by means spacing a distal tip portion of said male member therefrom, said distal tip portion being sized to fit through said aperture of said female member, and a bore being formed in and extending through said distal tip portion of said male member; and a lock comprising a hasp fitting through said bore in said distal tip portion of said male member, for preventing removal of said male member from said female member.

17. The support assembly of claim 16, wherein said aperture in said female member extends generally vertically, and said bore in said male member extends generally horizontally.

18. The support assembly of claim 16, wherein said female member is mounted to said vertical structure and said male member is mounted to said refuse can, whereby said distal end of said male member extends generally downwardly from said proximal end thereof.

19. The support assembly of claim 16, wherein said base support comprises means opening generally vertically for receiving a segment of a flange whereby a side wall of a refuse can is joined to a base thereof.

20. The support assembly of claim 19, wherein said refuse can is generally cylindrical, and said means opening generally vertically comprised by said base support comprises means defining an arcuate recess for receiving a segment of a generally cylindrical flange thereof.

* * * * *